US007246652B2

(12) United States Patent
Fowler

(10) Patent No.: US 7,246,652 B2
(45) Date of Patent: Jul. 24, 2007

(54) CERAMIC CORE RECOVERY METHOD

(75) Inventor: Jeffery A. Fowler, Bristol (GB)

(73) Assignee: Rolls-Royce PLC, London (GB)

( * ) Notice: Subject to any disclaimer, the term of this patent is extended or adjusted under 35 U.S.C. 154(b) by 399 days.

(21) Appl. No.: 11/126,272

(22) Filed: May 11, 2005

(65) Prior Publication Data

US 2005/0274477 A1 Dec. 15, 2005

(30) Foreign Application Priority Data

Jun. 11, 2004 (GB) ..... 0413027.4

(51) Int. Cl.
*B22C 9/00* (2006.01)

(52) U.S. Cl. ..... 164/516; 164/24; 164/35; 164/45

(58) Field of Classification Search ..... 164/516, 164/24, 34, 35, 45, 235
See application file for complete search history.

(56) References Cited

U.S. PATENT DOCUMENTS 3,770,044 A * 11/1973 Heath ..... 164/35
5,073,696 A * 12/1991 Patillo et al. ..... 219/233
5,350,002 A * 9/1994 Orton ..... 164/24
6,435,256 B1 8/2002 Anderson et al.

FOREIGN PATENT DOCUMENTS

GB 2 260 284 A 4/1993

* cited by examiner

*Primary Examiner*—Patrick Joseph Ryan
*Assistant Examiner*—Ing-Hour Lin
(74) *Attorney, Agent, or Firm*—Oliff & Berridge, PLC

(57) ABSTRACT

A method to recover wax from wax patterns used in investment casting using a lost wax technique without damaging incorporated ceramic cores is disclosed that includes subjecting the wax pattern to specific conditions. These conditions include chilling a casting tool including the wax pattern and ceramic cores such that a brittle transition temperature for the wax material is approached. Once chilled the wax pattern is subjected to brittle fracture release of the wax from the underlying ceramic cores without damage to those cores.

7 Claims, 1 Drawing Sheet

CERAMIC CORE RECOVERY METHOD

BACKGROUND

The present invention relates to a ceramic core recovery method and more particularly to such a recovery method utilised with regard to wax patterns used in investment or lost wax casting processes.

The process of investment casting utilising a lost wax technique is well known. Essentially, a wax pattern is created which is a facsimile of the component eventually to be manufactured and that wax lost to leave a mould for forming the component. Wax is used because of its ready mouldability and suitability for shaping.

With regard to formation of some components, it is necessary to incorporate ceramic cores or coring within the wax pattern. These ceramic cores allow the formation of cavities or passages within the eventual product. A typical investment moulding technique involves creation of the wax pattern with ceramic coring and then utilising that combination as a casting tool from which a mould is created from a ceramic slurry for subsequent casting of the final product. The ceramic cores remain in place in the mould for final component casting.

Unfortunately, the wax patterns may be improperly formed at the initial injection moulding stage and/or subsequently damaged during handling or wax transportation. Clearly, defective wax patterns are unsuitable for further processing and must be scrapped. Unfortunately, the ceramic cores or coring are relatively expensive but fragile so that they are easily damaged during any salvaging procedure. These problems are further exacerbated where bespoke ceramic coring is used with regard to prototype castings, etc.

SUMMARY

In accordance with the present invention there is provided a method of ceramic core recovery from investment casting wherein ceramic coring is secured within an appropriately formed wax pattern in order to provide a casting tool, the method characterised in that the casting tool is inspected for acceptability, and if found to be unacceptable for subsequent casting procedures then that casting tool is chilled under specific conditions substantially towards a brittle transition temperature for the wax material of the formed wax pattern whereby the pattern can be removed from the ceramic coring by brittle fracture release.

Preferably, the specific conditions comprise chilling at a temperature in the range −70 to −80° C., preferably −75° C. for a period of 20 to 30 minutes dependent upon wax pattern sizing and thickness. Additionally, the specific conditions comprise uniform environmental chilling about the wax pattern to avoid differential or shock chilling gradients across the wax pattern which may impose stressing upon the ceramic core. Normally, the specific conditions include ensuring that the wax pattern when chilled is in an unrestrained state.

Generally, chaplets are used to position the ceramic core within the wax pattern.

Typically, brittle fracture release is further facilitated by use of a blunt tool.

Generally, the specific conditions for chilling of the wax pattern are chosen such that any buttering and/or chaplets attached to the ceramic coring prior to wax pattern injection forming is retained after brittle fracture release.

BRIEF DESCRIPTION OF THE DRAWINGS

An embodiment of the present invention will now be described by way of example with reference to the accompanying drawings in which.

DETAILED DESCRIPTION OF EMBODIMENTS

As indicated above, the process of investment moulding utilising a so called lost wax technique is well known. UK Patent Application No. 9217477 (Rolls Royce Plc) describes a method of creating a mould for investment casting. As part of this process a wax pattern is created upon which a ceramic slurry is formed in order to solidify into an appropriate casting mould. In order to create cavities and passages within a component it is necessary to incorporate pre-formed ceramic cores or coring. In such circumstances, about this pre-formed coring a waxed mould is created by an appropriate injection or other moulding technique. In such circumstances, the solidified ceramic slurry as well as the pre-formed ceramic cores become associated in order to create an appropriate ceramic mould for a final component.

The present invention relates to recovery of such ceramic coring when the intermediate wax pattern is found to be unacceptable. Such unacceptability may be due to any irregularity in the moulding process, inappropriate or accidental component handling damage or wax sag or other distortion in storage. It will be understood that recovery of ceramic coring is advantageous in view of the cost of creating such ceramic coring, but the nature of the wax pattern may require use of prior salvaging techniques, such as scraping, which may damage the underlying ceramic cores.

Figure 2:
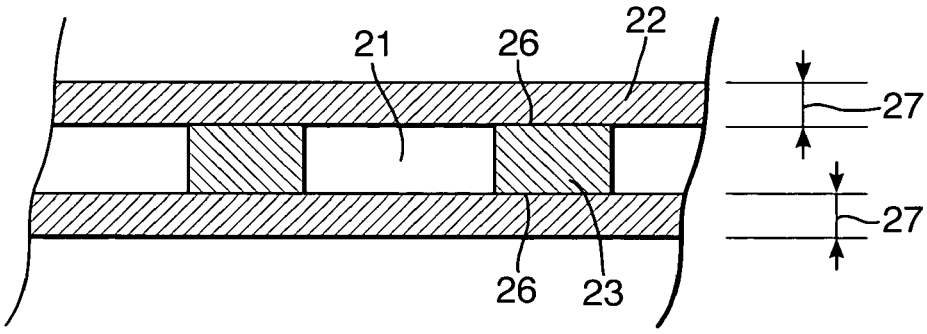
FIG. 2 is a schematic cross-section of a portion of a wax pattern incorporating a buttered ceramic core.
Figure 3:
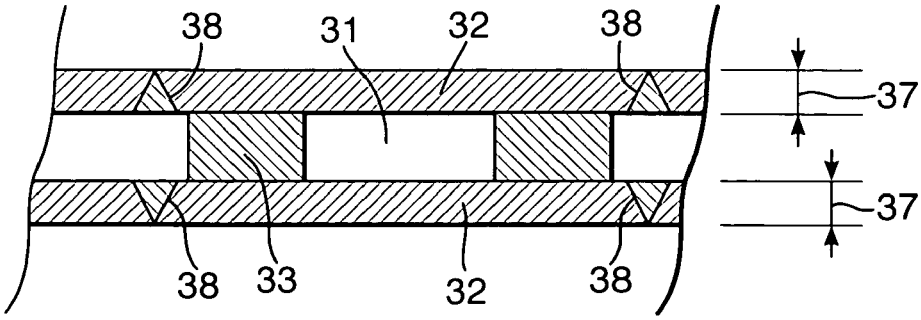
FIG. 3 is a schematic cross-section of a portion of wax pattern incorporating chaplets for regulation of wax wall thickness.

FIGS. 2 and 3 illustrate schematic sections of a portion of respective wax patterns.

Figure 1:
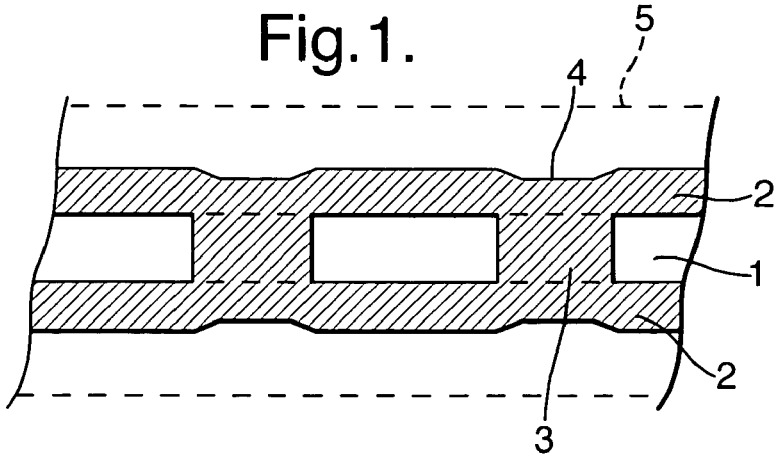
FIG. 1 is a schematic cross-section of a portion of wax pattern with a non-buttered ceramic core.

In FIG. 1 ceramic core 1 is embedded within a wax pattern 2. At a hole window feature 3, it will be noted that there are dimples 4 in the exterior surface of the wax pattern 2. These dimples 4 are due to molten wax contracting at known rates as solidification occurs. In such circumstances, this contraction in the substantially solid, unsupported hole, window feature portion 3 creates the dimples 4 illustrated.

Clearly, with such dimples 4, any ceramic slurry formation (shown by broken line 5) will incorporate these dimples 4. In such circumstances, the eventual casting mould created from the casting tool comprising the wax pattern 2 and ceramic core 1 would itself be unacceptable. The dimples 4 would be transferred into the final component casting with such a ceramic casting mould formed by a slurry 5 about the wax pattern 2.

In order to avoid the above problem with dimpling, there is a known technique of so called "buttering". In such circumstances, as illustrated in FIG. 2, prior to molten wax moulding of a wax pattern 22 hole, window feature 23 is pre filled with a wax infill. The wax infill is allowed to solidify in the hole, window feature portion 23 within the ceramic core 21 prior to injection moulding of the wax pattern. In any event, prior to such creation of the wax pattern 22 by application of molten wax, the surface 26 across the hole, window feature portion 23 of the core 21 is substantially flat.

In such circumstances the molten wax applied to create the final wax pattern 22 only has a solidification depth 27 and then only of limited thickness such that there is limited and then substantially equalised contraction in order to avoid dimpling and other distortions in the finally solidified wax pattern 22. By avoiding such dimpling, the eventual casting mould created by application of a ceramic slurry about the wax pattern 22 is not distorted by the differential contractions inherent in the non buttered core described with regard to FIG. 1. Retention of the wax used for buttering after salvage would be beneficial for further wax pattern formation with the salvaged cores.

Once the wax pattern is formed with the ceramic cores, as indicated, a ceramic slurry is applied in order to create a final ceramic moulding cast within which typically molten metal will be used to form a final component. Prior to such a formation however, the wax from which the wax pattern is formed must be removed, and this is achieved by a simple heating process in order to render the wax molten, so that it flows out of the solidified ceramic mould, that is to say the wax is lost. The injected wax for wax pattern formation, as well as any wax buttering holes, window features of the core (FIG. 2), must be removed by this melting process in order to leave a ceramic casting mould for creation of the final product.

FIG. 3 illustrates use of chaplets 38 in order to provide regulation of the wall thickness of a pattern 32. Thus, the wax pattern 32 is again formed utilising a ceramic core 31 hole, with window feature portions 33 pre filled with a wax to prevent dimpling. The chaplets 38 provide the required wax wall thickness 37. Chaplets 389 are small conical shaped plastic injection mouldings which have a base and a precisely configured peak, normally in the range 0.76 mm to 2.54 mm in order to ensure that the wax pattern wall thickness 38 is closely controlled. These chaplets 38 are applied to the ceramic core 31 to ensure correct positioning of the core 31 within the wax pattern 32 cavity. The number of chaplets 38 required is dependent upon the particular component to be cast and the ceramic core 31 geometry as well as the tolerance constraints imposed. Normally, the chaplets 38 are evacuated from the casting mould during the molten wax removal process.

From the above, it will be appreciated that significant time and effort is expended and involved with regard to creation of wax patterns from which a final ceramic casting mould is formed. Care is clearly taken with regard to creation of the respective wax pattern, but for a number of reasons, it may be necessary to scrap a particular wax pattern for unacceptability. Typical defects are associated with the creation of wax flow lines, incorrect dimensioning and breakage or distortion of the wax pattern during handling. If found unacceptable, the wax pattern must be scrapped, but as indicated typically this wax pattern will incorporate relatively high value and possibly limited availability ceramic cores.

In accordance with the present invention an unacceptable wax pattern will be chilled to a temperature whereby the wax becomes glassified or brittle, that is to say the wax approaches its glass or brittle transition temperature. In such circumstances, the surface wax is subject to brittle fracture release. In short, by application of hand or at most light blunt instrument pressure, the wax pattern is released from any underlying ceramic cores. Typically, the specific conditions for chilling of the wax pattern comprise presentation of the wax pattern in an unrestrained state, and at a temperature in the range −70 to −80° C., preferably −75° C., for a period of 20 to 30 minutes. Generally, chilling is performed within a chilling cabinet such that the whole of the wax pattern is exposed to chilling without any differential chilling across the wax pattern or shock chilling which may create stresses within the underlying ceramic. As indicated above, wax tends to contract at known rates whilst ceramics are more stable. In such circumstances, the wax is rendered into a brittle state with the underlying relatively dimensionally stable ceramic creating light stresses within the now brittle wax by the relative contraction with temperature. The brittle wax can then be easily removed as indicated by light brittle fracture release. It will also be understood that the underlying ceramic core will normally have a hardened or glazed surface, such that there is no surface porosity impingement between the ceramic core and the wax, again facilitating such brittle fracture release.

Due to the contractive nature of the chilled wax pattern, or at recessed or nodular sections of the underlying ceramic core, there may be a degree of "clamp" grip of source features, e.g. about chaplets and so use of a blunt spatula type tool may be necessary in order to remove wax at such positions.

It will be understood that it is important that ceramic cores are completely cleaned prior to use of such salvaged cores again in forming further wax patterns. Waste or redundant wax retained upon a ceramic core may not properly bond with further injection moulding wax to form a further wax pattern, and so create problems with respect to a new wax pattern, allowing appropriate formation of a final ceramic casting mould.

Because the present technique particularly relates to utilisation of the inherent contraction differentials at the surface between the ceramic core and the wax pattern, it will be understood that with care only that wax upon the surface of the ceramic cores may be removed such that so called wax buttering is held within the hole(s), window feature of the ceramic cores may be retained. For example, if the ceramic core is for a turbine blade then a cooling aperture at the base of that blade would normally be filled with wax as a hole in the ceramic core used to render the blade hollow. This wax is therefore constrained within that hole and so may not be so easily brittle fracture released. Furthermore, it will be understood that the wax is incorporated at a separate processing stage to the injection moulding wax to form the wax pattern. In such circumstances, there may be a base fracture layer between the wax and the secondly applied injection wax to form the wax pattern which can be utilised in order to facilitate brittle fracture release in accordance with the present invention.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A method of wax recovery from investment casting wherein ceramic coring is secured within an appropriately formed wax pattern in order to provide a casting tool, the method comprising the steps of:

inspecting the casting tool for acceptability for subsequent casting procedures;

if the casting tool is found to be unacceptable, chilling the casting tool under specific conditions substantially toward a brittle transition temperature for the wax material of the formed wax pattern; and removing the pattern from the ceramic coring by brittle fracture release.

2. A method as claimed in claim 1, wherein the specific conditions comprise chilling at a temperature in the range −70 to −80° C., preferably −75° C. for a period of 20 to 30 minutes dependent upon wax pattern sizing and thickness.

3. A method as claimed in claim 1, wherein the specific conditions comprise uniform environmental chilling about the wax pattern to avoid differential or shock chilling gradients across the wax pattern which may impose stressing upon the ceramic core.

4. A method as claimed in claim 1, wherein the specific conditions include ensuring that the wax pattern when chilled is in an unrestrained state.

5. A method as claimed in claim 1, wherein chaplets are used to position the ceramic core within the wax pattern.

6. A method as claimed in claim 1, wherein brittle fracture release is further facilitated by use of a blunt tool.

7. A method as claimed in claim 1, wherein the specific conditions for chilling of the wax pattern are chosen such that any buttering and/or applied chaplets to the ceramic coring prior to wax pattern injection forming is retained after brittle fracture release.

* * * * *